United States Patent [19]

Enokido

[11] 4,453,050

[45] Jun. 5, 1984

[54] EARPHONE

[75] Inventor: Kazuhiro Enokido, Yokohama, Japan

[73] Assignee: Sony Corporation, Tokyo, Japan

[21] Appl. No.: 354,035

[22] Filed: Mar. 2, 1982

[30] Foreign Application Priority Data

Mar. 10, 1981 [JP] Japan ..... 56-33352[U]

[51] Int. Cl.[3] ..... H04R 1/10

[52] U.S. Cl. ..... 179/182 R; 179/182 A; 179/156 R

[58] Field of Search ..... 179/182 R, 182 A, 107 H, 179/156 R; 2/209

[56] References Cited

U.S. PATENT DOCUMENTS

| | | | |
|---|---|---|---|
| D. 237,090 | 10/1975 | Yanagawa | 179/156 R |
| 1,581,882 | 4/1926 | Stace | 179/156 R |
| 1,587,643 | 6/1926 | Harman | 179/156 R |
| 2,474,135 | 6/1949 | White | 179/107 H |
| 3,862,378 | 1/1975 | Norris | 179/107 H |
| 3,906,478 | 9/1975 | Smey | 179/107 H |

FOREIGN PATENT DOCUMENTS

| | | | |
|---|---|---|---|
| 244384 | 12/1925 | United Kingdom | 179/156 R |
| 270187 | 5/1927 | United Kingdom | 179/156 R |
| 2096861 | 10/1982 | United Kingdom | 179/156 R |

*Primary Examiner*—Harold I. Pitts
*Assistant Examiner*—L. C. Schroeder

[57] ABSTRACT

An improved earphone comprises a housing with a transducer therein. A rod member in fixed connection with the housing is provided along with a separating element which is connected at one end to frictionally slide along the rod member but without rotating relative thereto. A curved lever is provided at the other end of the separating element which has a free end portion to be engaged on the ear. The transducer is spaced an appropriate distance for radiating sound into the ear and can be aligned relative to an angle of the ear without placing excessive pressure on the ear.

13 Claims, 19 Drawing Figures

EARPHONE

BACKGROUND OF THE INVENTION

1. Field of the Invention

This invention relates to earphones of the type engaged with the user's ear and, more particularly, to an earphone of the type carried on the external flap, or lobe, of the ear, and which is adapted to improve the feel of fit on the ear and also to improve the transducer characteristics.

2. Description of the Prior Art

As the prior art transducer of the type engaged with the ear, there is one in which the body of a transducer is provided with an integral loop-shaped curved engagement section mounted on the outer surface of the body such that it extends in the direction of the sound radiating surface of the transducer. In this earphone, a ring-like thick pad is provided to project from the edge of the sound radiating surface of the transducer body.

When fitting the above earphone on the ear-lobe, the ear-lobe is inserted into an annular portion formed by the body and curved engagement section, whereby the earphone is held on the ear-lobe by the retaining force produced by the elastic deformation of the ear-lobe and elastic deformation of the pad and also the retaining force produced by the engagement between the curved engagement section and ear-lobe that results from the insertion of the ear-lobe into the annular portion.

With the earphone of that type engaged on the ear, however, the shape and size of the curved engagement section are fixed, so that the readiness of the insertion of the ear-lobe varies with the user, and it is likely that the ear-lobe is excessively tight or there may be a feel that the earphone may fall off. Further, since the height of the ear hole with respect to the ear-lobe varies with the user, it is likely that the sound radiating surface fails to be correctly positioned with respect to the ear hole, that is, it may fail to be located at the optimum sound collection position. Further, the angle of the ear-lobe with respect to the side of the head varies with the user, so that it is likely that a force tending to crush part of the ear-lobe is generated and that the sound radiating surface is not uniformly set with respect to the hear hole, thus spoiling the sound quality.

There is also a different type of prior art earphone of the type engaged on the ear, in which the engagement section is constituted by an arcuate rod-like spring. This earphone is superior to the aforementioned earphone having the loop-shaped engagement section in respect of the readiness of fitting on the ear-lobe. However, the state in which the earphone is fitted on the ear-lobe is not so stable as with the first-mentioned earphone, and therefore deterioration of the sound quality in common. Further, since the position of mounting of the curved lever section with respect to the base is fixed in spite of the fact that the position of the ear hole with respect to the entire ear-lobe varies with the user, it is difficult to locate the sound radiating surface in the optimum sound collection position with respect to the ear hole. Further, since the mounting position is fixed, as mentioned earlier, in spite of the fact that angle of the ear-lobe with respect to the side of the head varies with the user, when the curved engagement section is fitted on the ear-lobe, the ear-lobe is liable to be partly crushed. In such a case, the sound radiating surface cannot be uniformly fitted with respect to the ear hole, thus spoiling the sound quality.

As a further variety of prior art earphone of the type engaged on the ear, there is one in which a base is provided on the outer side surface of the transducer body and one end of a curved lever section which is made of a flexible rod member and has arcuate shape is mounted on the base. In this earphone, a ring-like thick pad is mounted on the edge of the sound radiating surface of the front of the transducer body. When fitting this earphone on the ear-lobe, the ear-lobe is inserted into the space between the transducer body and curved lever section, whereby the earphone is fitted on the ear-lobe such that the ear-lobe is clamped between the transducer body and curved lever section by the spring force of the curved lever section.

OBJECTS AND SUMMARY OF THE INVENTION

The primary object of the present invention is to provide an earphone of the type engaged on the ear, which can overcome the drawbacks inherent in the prior art as described above.

A second object of the present invention is to provide an earphone of the type engaged on the ear, which can be held on the ear-lobe without clamping the ear-lobe between a curved lever action and transducer section but with the curved lever section engaged on the ear-lobe.

A third object of the present invention is to provide an earphone of the type engaged on the ear, which, when fitted on the ear-lobe, permits the transducer to be located at the optimum sound collection position without deforming the ear-lobe.

A further object of the present invention is to provide an earphone of the type engaged on the ear, which can use a pad of a thin film structure which has not hitherto been used.

According to one form of the present invention, there is provided an earphone of the type engaged on the ear, which comprises a housing accommodating a transducer, a rod member connected to the housing, curved lever means having one end portion designed as a free end portion to be engaged on the ear and separating, or spacing, means supporting the rod member and connected to the other end portion of the curved lever means for spacing the transducer section a predetermined distance with respect to the curved lower section toward the sound radiating surface of the transducer section.

Other objects, features and advantages of the present invention will be apparent from the following descriptions taken in conjunction with the attached drawings.

DETAILED DESCRIPTION OF THE PREFERRED EMBODIMENTS

Now, an embodiment of the present invention will be described with reference to the drawings.

Figure 1:
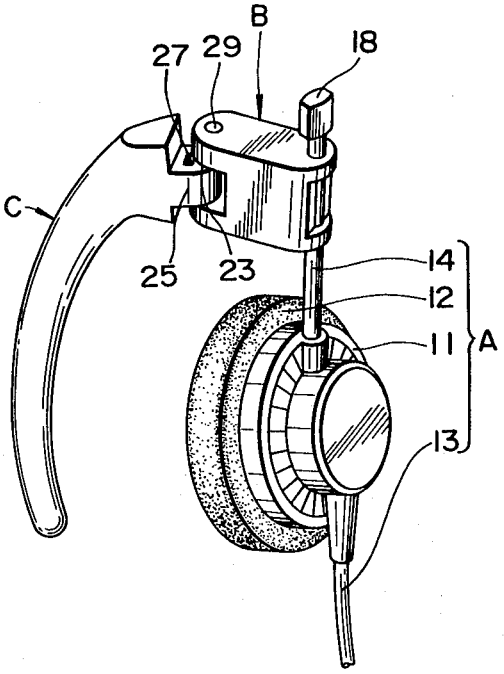
FIG. 1 is a perspective view showing one embodiment of the earphone of the type engaged on ear according to the present invention.
Figures 2A, 2B, 2C:
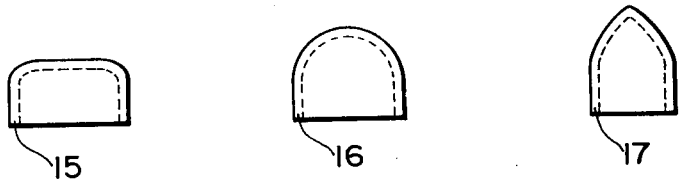
FIGS. 2(*a*), 2(*b*) and 2(*c*) are views showing respective examples of the ear pad used in the earphone of the type engaged on ear according to the present invention.

FIG. 1 is a perspective view showing a transducer device of the type engaged on an ear. Designated at A is a transducer which includes a housing 11 accommodating a transducer circuit, a pad or cover 12 mounted on a sound radiation surface of the housing, a cord 13 connected to the transducer circuit and led out from the lower end of the housing 11 and a rod member 14 projecting from the upper end of the housing 11. The housing 11 is a one-piece molding of a synthetic resin or like material, and its back side is formed with a number of holes to permit escapement of opposite phase sound signals. Instead of the pad 12 a pad 15 (as shown in FIG. 2(*a*)) may be used which is a pan-shaped thin urethane foam member secured with a slack to the edge of the sound radiating surface of the housing 11 such that its side on the sound radiating surface projects. Alternatively, one may use a pad 16 as shown in FIG. 2(*b*), which is a thin urethane foam member mounted in a form having a circular profile with a support member inserted in it, or a pad 17 as shown in FIG. 2(*c*), which is a thin urethane foam member mounted with a separate shape-holding member provided inside it such that it projects substantially in a conical form. The cord 13 is on the lower end of the housing 11 from the standpoint of the feel of use of the transducer section and the prevention of the detachment of the section from the ear-lobe. The rod member 14 consists of reinforced composite material having substantially a semi-circular cross-section and comprising a metal wire or a synthetic resin. Its peripheral surface is smooth, and it is provided at the upper end with an increased diameter stop 18 for preventing detachment of the rod member 14 through substantially semi-circular slide holes formed in a separating section to be described later.

Figure 3:
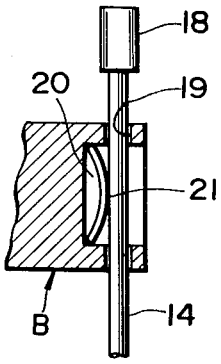
FIG. 3 is a fragmentary sectional view showing the structure of sliding between rod member and separating section of the embodiment shown in FIG. 1.
Figure 4:
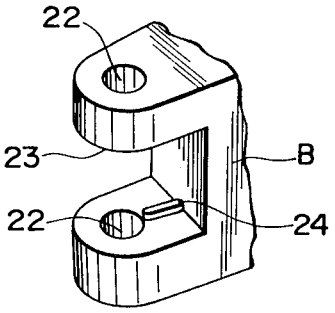
FIG. 4 is a fragmentary perspective view showing a separating section in the embodiment shown in FIG. 1.

In FIG. 1, designated at B is a light-weight separating section which is formed using a synthetic resin or a composite material and is provided between the aforementioned transducer section A and a curved lever section C to be described later. As shown in FIG. 3, the separating section B is formed in one end portion with a substantially semi-circular (or other irregular form) vertical hole 19, through which the rod member 14 mentioned above penetrates, and also with a notch 2 crossing the vertical hole 19 and open to the outside in a sector-like form, and is provided with a leaf spring 21 of a synthetic resin or stainless steel, which is inserted in the notch 20 and has an arcuate surface biasing the rod member 14. The other end portion of the separating member B comprises a hinge section with respect to the curved lever section. As shown in FIG. 4, this end portion is provided with a pin receiving hole 22 and also with a notch 23 crossing the pin receiving hole 22 and open to the outside. Further, a ridge 24 is formed along the center of one end surface defining the notch 23. The vertical side surface defining the notch 23 supports the side surface of a projection 25 of the curved lever section and restricts the rotation of the curved lever section in excess of a predetermined range.

Figure 5:
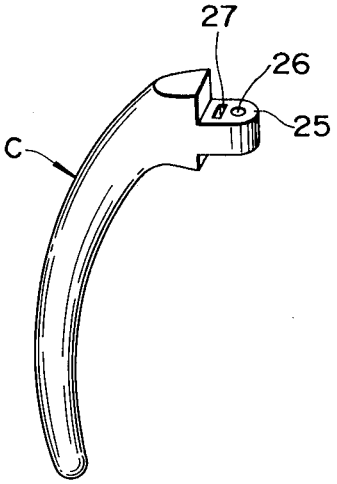
FIG. 5 is a fragmentary perspective view showing a curved lever section in the embodiment shown in FIG. 1.
Figure 6:
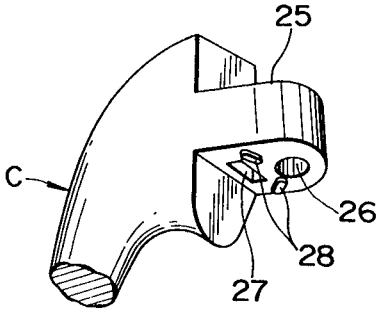
FIG. 6 is an upward perspective view showing the separating section of the embodiment shown in FIG. 5.

In FIGS. 1 and 5, the curved ear section is designated at C, is made of a synthetic resin, and has an arcuate curved form as a whole. As shown in FIG. 5, its upper end is provided with a central projection 25 which extends in the notch 23 mentioned above. As shown in FIG. 6, the projection 25 is formed with a vertical pin receiving hole 26 and also a vertical rectangular hole 27. Also, the lower surface of the projection 25 is formed with a pair of projections 28. It is possible to lead the code 13 through the curved lever section C.

Figure 7:
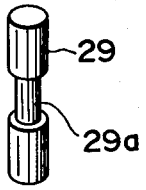
FIG. 7 is a perspective view showing a pin in the embodiment shown in FIG. 1.
Figure 8:
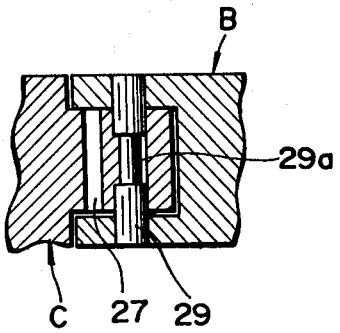
FIG. 8 is a sectional view showing a rotational coupling mechanism between the separating section and curved lever section of the embodiment shown in FIG. 1.

The projection 25 is received in the notch 23 in the separating section B, and a pin 29 as shown in FIG. 7 is inserted in the pin receiving holes 26 and 22 so that the curved lever section C can be rotated with respect to the separating section B about the pin 29, as shown in FIGS. 8 and 1. The curved lever section can be freely rotated in a range in which the ridge 24 is found between the opposite projections 28. When either one of the projections 28 is brought into engagement with the ridge 24, the curved lever section C engages the ear-lobe at an adequate angle. When the ridge 24 is straddled by the projection 28, the side surface of the curved lever section C is found substantially in the same plane as the sound radiating surface of the transducer A. The pin 29 has an intermediate reduced-diameter portion 29*a*, with which a leaf spring provided in the rectangular hole 27 engages to provide a resilient snug fit of the pin 29 with respect to the pin receiving hole 26.

Figure 9:
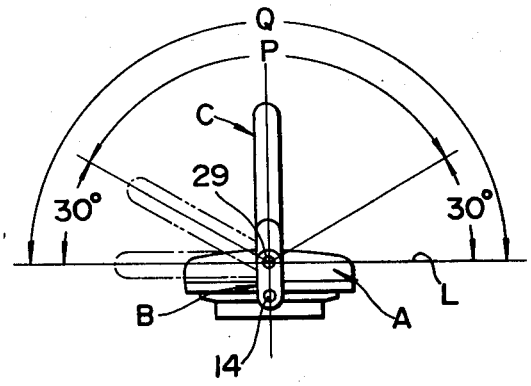
FIG. 9 is a view illustrating the range of rotation of the curved lever section in the embodiment of FIG. 1.

As shown in FIG. 9, the ridge 24 provided at the notch 23 of the separating section B engages the projections 28 provided on the projection 25 of the curved lever section C when the curved lever section C is at a position of an angle of 30° about the pin 29 respectively leftwards and rightwards with respect to the sound radiating surface L of the transducer A. The curved lever section C is thus temporarily held at the position of an angle of 30° with respect to the transducer A.

Figure 10:
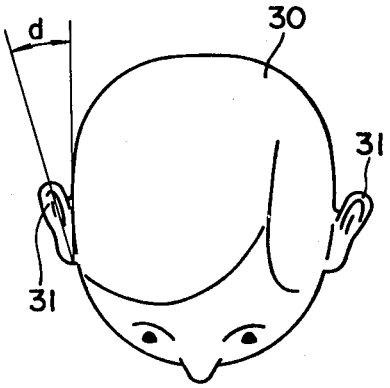
FIG. 10 is a view showing the shape of the ear-lobe for the explanation of the range of rotation of the curved lever section in the embodiment of FIG. 9.

The curved lever section C can be freely rotated over a first range P subtending an angle of 120° and exclusive of the aforementioned engagement positions and also over second range Q subtending an angle of 180°. Thus, by strongly pushing the curved lever section C after it has been rotated over the first range P, a stop action takes place due to the ridge 24 and projection 28, and subsequently it can be rotated over the second range Q. When the curved lever section C is rotated in the first range P up to the position at which the ridge 24 engages with the projection 28, it makes an angle of 30° with the aforementioned sound radiating surface L. That is, in this stage, its angle is substantially equal to the average angle d (about 30°) of the ear-lobe 31 with respect to the side of man's head 30 as shown in FIG. 10. When the curved lever section C is rotated in the opposite direction, it may be set to suit the right hand ear-lobe in FIG. 10. The second range Q of rotation is one over which the curved lever section C can be rotated until either side surface of the projection 25 is brought into engagement with the side surface of the notch 23 shown in FIG. 1. With this arrangement, at its position in the neighborhood of the boundary between the first and second ranges P and Q of rotation the curved lever section C can be locked to make the angle between it and the sound radiating surface L to be substantially 30°. Thus, when adjusting the angle between the curved lever section C and sound radiating surface L after the earphone is set on the ear-lobe or when setting the earphone on the ear-lobe after adjusting the angle between the curved lever section C and sound radiating surface L, it is possible to prevent the curved lever section C or transducer section A from excessively urging the ear-lobe 31. Also, it is possible to make the sound radiating surface L substantially parallel to the ear-lobe 31 to permit natural sound to be caught.

Figure 11:
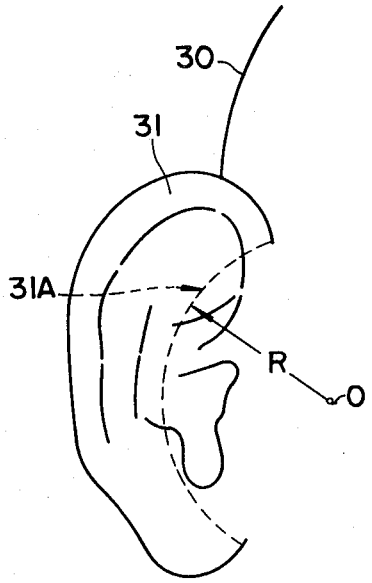
FIG. 11 is a view showing the relation between the shape of the ear-lobe and ideal sound collection point.
Figure 12:
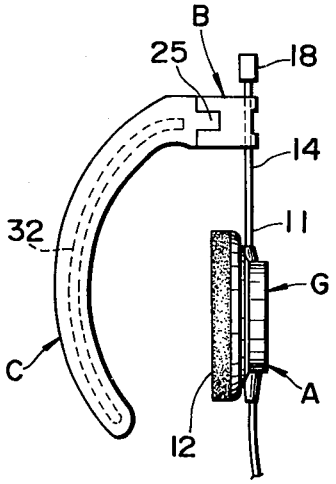
FIG. 12 is a side view showing the embodiment shown in FIG. 1.

The man's ear-lobe 31 usually has a substantially arcuate form at its stem as shown by a dashed curve 31A in FIG. 11. If the center 0 of the circle 31 of the stem of the ear-lobe 31 is made to be an ideal sound collection point, the radius of this circle of the stem of the ear-lobe 31 is 27 mm on the average in Japan. With the earphone of the type engaged on the ear, the sound collection source in the case of the open air type can be thought to be substantially the rear end of the transducer section when the spread of sound and turnaround thereof is taken into consideration. If this imaginary sound collection point G is made to substantially coincide with the aforementioned ideal sound collection point, most natural sound with high sense of presence in the neighborhood of the source of sound can be obtained. For this reason, the curved lever section C is formed to be arcuate with the center thereof set to the imaginary sound collection point G of the transducer A and the radius set to be substantially 30 mm. The curved lever section C is formed by burying a core 32 such as a wire in a synthetic resin and has a circular or oval sectional profile. If necessary, it may be covered with an elastic material such as sponge or rubber. Further, since the height of the ear hole in the ear-lobe 31 is not fixed but varies with the user, the rod member 14 mentioned above is made movable through the hole 19 in the separating section B to set the imaginary sound collection point G to an optimum point at which the best quality of sound can be obtained.

Figure 13A:
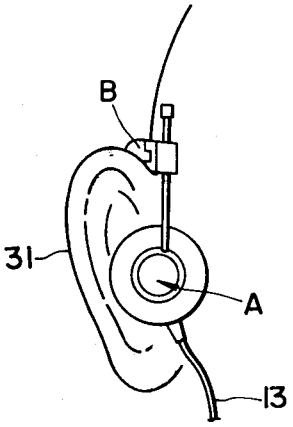
FIGS. 13(*a*) and 13(b) are views illustrating the method of use of the embodiment shown in FIG. 1.
Figure 13B:
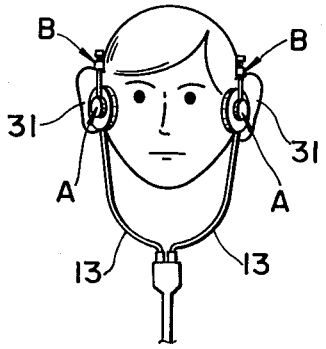
Figure 14:
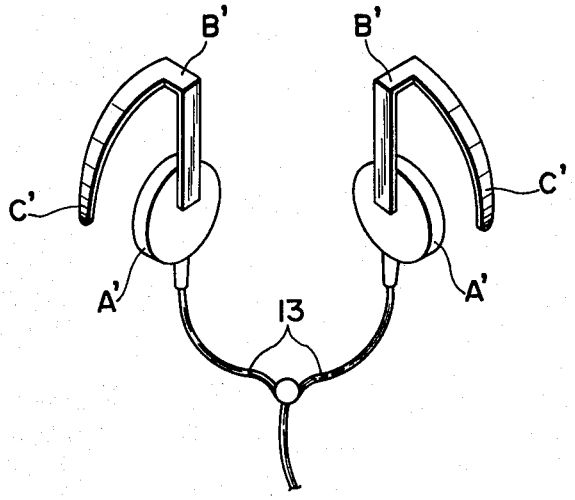
FIGS. 14, 15 and 16 are perspective views showing different embodiments of the present invention.

FIG. 13(*a*) shows a monaural playback state in which the earphone of the construction described above type engaged on ear is set on a single ear. FIG. 13(*b*) shows a stereophonic playback state, in which two earphones of the same aforedescribed construction are used and set on both ears. In the case of FIG. 13(*b*), a symmetrical earphone set which is fitted to both ears as shown in FIG. 14 may be used. In this case, curved lever sections C′ are secured to transducer sections A′ via separating sections B′, and they are not rotatable.

Figure 15:
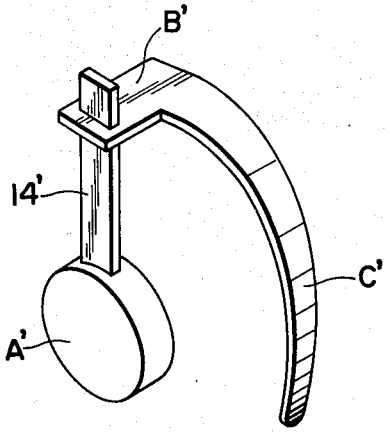
Figure 16:
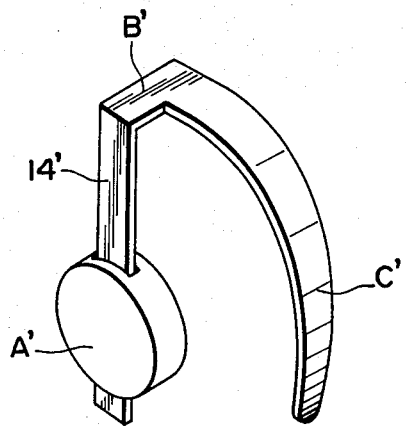

Further, in case of a user who has a particular ear on which to set a monaural type earphone, the curved lever section need not be rotatable for the reason as mentioned. Thus, in this case a separating section B′ which is integral with a curved lever section C′ may be vertically movably mounted on a rod member 14′ projecting from a transducer section A′, as shown in FIG. 15, or a transducer section A′ may be movably mounted with respect to a rod member 14′ integral with both a curved lever section C′ and separating section B′, as shown in FIG. 16, thus permitting the adjustment of the imaginary sound collecting point G of the transducer section A′ to the optimum point for obtaining the best quality of sound.

As has been described in the foregoing, with the earphone of the type engaged with the ear according to the invention, which comprises a transducer section including a transducer, a curved lever section provided on the transducer section and capable of being engaged on the ear-lobe and a separating section for spacing the transducer section from the curved lever section a predetermined distance toward the sound radiating surface of the transducer section, the transducer section can be held in operating position without sandwiching the ear-lobe between the curved lever section and transducer section but by having the curved lever section engaged on the ear-lobe, so that the feel of use of the earphone can be improved. Also, since the ear-lobe is not deformed, more natural sound quality can be obtained. Further, since the curved lever section is rotatably mounted on the transducer section and is adapted to be temporarily locked after it has been rotated over a range of substantially 25° to 35° with respect to the sound radiating surface of the transducer section, there is no possibility of excessively pressing the ear-lobe and the feel during use is substantially improved compared to the prior art earphone. Further, the sound radiating surface can be held in engaged fashion substantially parallel to the ear-lobe, thus permitting natural sound to be heard. Further, by positioning the center of rotation of the curved lever section substantially on the same plane as the aforementioned sound radiating surface, the sound radiating surface can be held parallel to the ear-lobe even with the rotation of the curved lever section, so that various effects such as the prevention of changes in the transducer characteristics can be obtained. Further, with the radius of the curved lever section set to substantially 25 mm to 35 mm, with the imaginary sound collection point of the transducer section having the transducer set to substantially coincide with the ideal sound collection point of the ear and with the transducer section adapted to be held on the ear-lobe without deforming the ear-lobe, it is possible to improve the sound quality and alleviate the fatigue of the ear. Thus, the invention is very useful in practice.

I claim as my invention:

1. An earphone comprising:

a housing accommodating a transducer;

a rod member connected in fixed non-rotatable manner to said housing;

curved lever means having one end portion designed as a free end portion to be engaged on the ear; and separating means at one end being frictionally slidably supported on said rod member to permit up and down movement of the separating means along the rod member but with restraining means for preventing rotation of the separating means relative to the rod member, and a hingeable connection at its opposite end to the other end portion of said curved lever means, said separating means providing a predetermined spacing from said transducer to said curved lever means.

2. An earphone according to claim 1 wherein said separating means extends substantially perpendicularly from said rod member and said curved lever means has a projection received in a notch of said separating means with a hinge pin hingeably retaining the projection within the notch.

3. An earphone according to claim 1 wherein an axis of rotation of the hingeable connection is placed approximately in a plane of a planar sound radiation surface of said transducer.

4. An earphone according to claim 1 wherein the hingeable connection comprises a convex projection surface of the other end portion of said curved lever means, a convex surface of said separating means, a notch at said separating means convex surface, and a generally vertical pin means for pivotally connecting the projection surface within the notch.

5. An earphone according to claim 2 wherein said hingeable connection has cooperating overrideable stop means for determining a given rotational angle of the curved lever means with respect to said housing.

6. An earphone according to claim 5 wherein said rotational angle is from 25° to 35° with respect to a plane parallel to a sound radiation surface of the housing.

7. An earphone according to claim 1, wherein said separating means is frictionally slidably supported on said rod member and is held on said rod member by a stop mounted at the free end of said rod member.

8. An earphone according to claim 7 wherein said restraining means for preventing rotation of said separating means relative to the rod member comprises an irregularly shaped rod member received in a corresponding irregularly shaped aperture.

9. An earphone according to claim 1 wherein said predetermined spacing from said transducer to said curved lever means and a curvature of said curved lever means are chosen such that an imaginary sound collection point of the transducer substantially coincides with a center of curvature of the curved lever means.

10. An earphone according to claim 1 wherein a radius of curvature of said curved lever means is from about 25 mm to about 35 mm.

11. An earphone, comprising:

a housing with the transducer therein;

a rod extending substantially perpendicularly to a radiation direction of sound from the transducer;

a separating section having one end frictionally and slidably connected to the rod for up and down slidable movement therearound, said separating section projecting perpendicularly of an axis of the rod;

a curved ear section; and pivot means connecting one end of the curved ear section to the opposite end of the separating section, said pivot means limiting an angle of pivot of the curved ear section relative to the separating section to within a given range.

12. An earphone according to claim 11 wherein the separating section is non-rotatable relative to the housing.

13. An earphone according to claim 11 wherein both the hingeable connection at one end and the slidable connection at the other end of the separating section are directly laterally adjacent one another in a direction perpendicular to the rod axis.

* * * * *